US008047371B2

(12) United States Patent
Li et al.

(10) Patent No.: US 8,047,371 B2
(45) **Date of Patent: *Nov. 1, 2011**

(54) PACKING CUSHION

(75) Inventors: Qian Li, Shenzhen (CN); Jun Ma, Shenzhen (CN); Xin-Yue He, Shenzhen (CN); Wan-Ling Shih, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/760,745

(22) Filed: Apr. 15, 2010

(65) Prior Publication Data

US 2010/0326874 A1 Dec. 30, 2010

(30) Foreign Application Priority Data

Jun. 26, 2009 (CN) ..... 2009 2 0305185 U

(51) Int. Cl.
*B65D 81/02* (2006.01)
*B65D 81/05* (2006.01)

(52) U.S. Cl. ..... 206/521; 206/592; 206/586

(58) Field of Classification Search ..... 206/521, 206/523, 586, 583, 587, 588, 590, 591, 453, 206/592, 594, 320

See application file for complete search history.

(56) References Cited

U.S. PATENT DOCUMENTS

| | | | | |
|---|---|---|---|---|
| 5,515,976 | A * | 5/1996 | Moren et al. | 206/586 |
| 5,678,692 | A * | 10/1997 | Gratz | 206/453 |
| 5,706,951 | A * | 1/1998 | Oinuma et al. | 206/710 |
| 6,082,546 | A * | 7/2000 | Liao et al. | 206/592 |
| 6,105,765 | A * | 8/2000 | Chu | 206/320 |
| 6,123,199 | A * | 9/2000 | Madsen | 206/586 |
| 7,044,303 | B2 * | 5/2006 | Van Der Werf | 206/586 |
| 2001/0020595 | A1 * | 9/2001 | Koike | 206/521 |
| 2004/0094448 | A1 * | 5/2004 | Koike | 206/521 |
| 2004/0168953 | A1 * | 9/2004 | Van Der Werf | 206/586 |
| 2007/0175779 | A1 * | 8/2007 | Imai | 206/308.3 |

* cited by examiner

*Primary Examiner* — Steven A. Reynolds
(74) *Attorney, Agent, or Firm* — Altis Law Group, Inc.

(57) ABSTRACT

A packing cushion includes a base and a plurality of sidewalls coupled to the base. The plurality of sidewalls interconnect with each other and cooperate with the base to form an accommodating space. First and second cushion portions protrude from an inner surface of the base and an inner surface of one of sidewalls respectively. The first cushion portion includes a first surface. The second cushion portion includes a second surface. A contour defined by the first surface matches with at least a part of an object to be packed. When the object is packed in the receiving space, the first surface contacts with at least a part of the object to provide a first cushioning, and when the object is subjected to an impact to deform the first cushion portion, the second surface contacts with the object to provide a second cushioning.

14 Claims, 2 Drawing Sheets

PACKING CUSHION

BACKGROUND

1. Technical Field

The present disclosure relates to packing cushions for stabilizing an object when packed.

2. Description of Related Art

In general, various products are boxed up for shipping and storage. However, many products are frangible and easily damaged during shipping if packed in a box directly without filler or padding. Therefore, packing cushions or the like are needed in the boxes to protect the products.

BRIEF DESCRIPTION OF THE DRAWINGS

The components of the drawings are not necessarily drawn to scale, the emphasis instead being placed upon clearly illustrating the principles of the embodiments of a packing cushion. Moreover, in the drawings, like reference numerals designate corresponding parts throughout several views.

DETAILED DESCRIPTION

Figure 1:
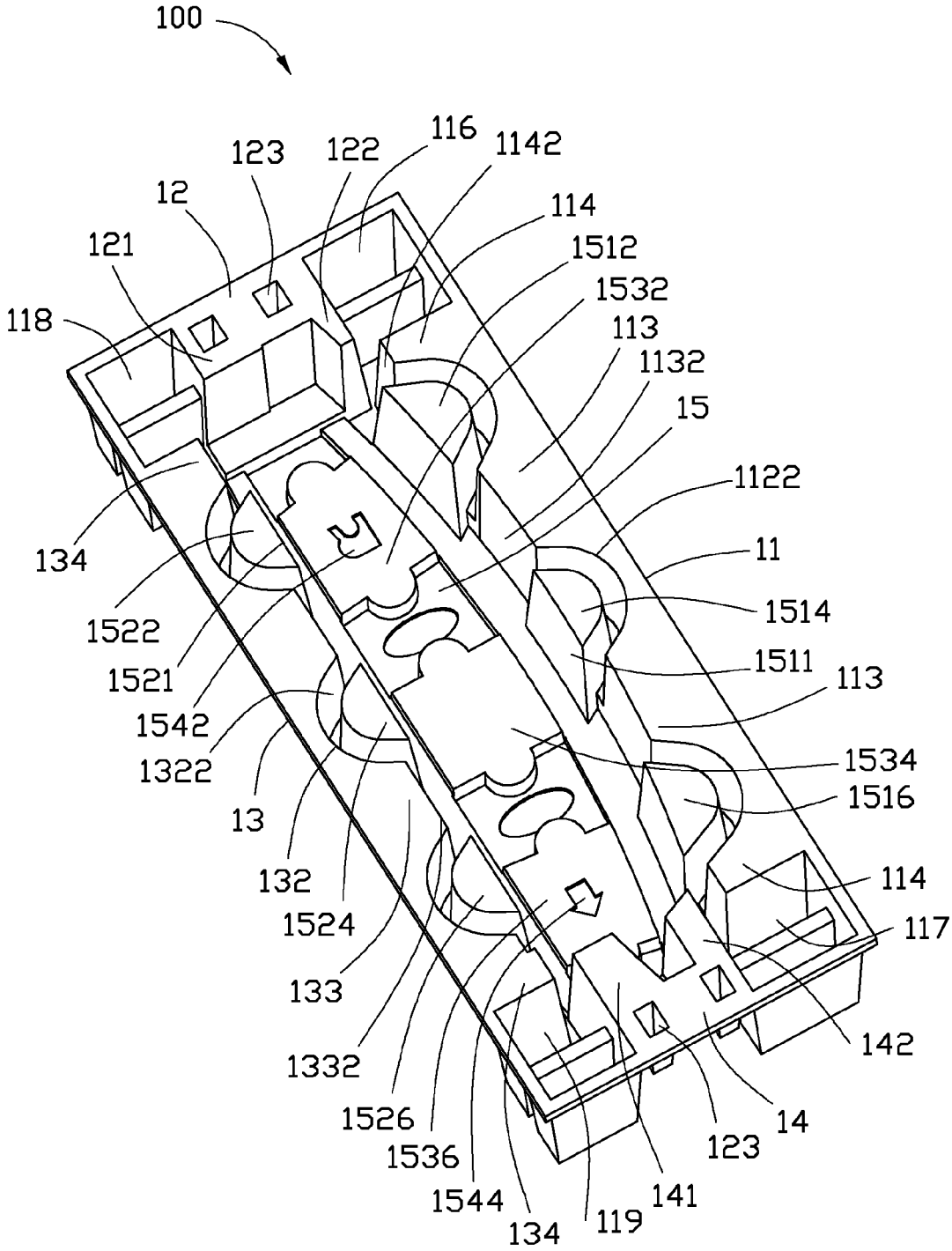
FIG. 1 is a perspective view of a packing cushion in accordance with one embodiment.

Referring to FIG. 1, a packing cushion 100 in accordance with an exemplary embodiment is shown. The packing cushion 100 can be used in boxes or other shipping containers to protect objects from shocks and vibrations during shipping, e.g., an electronic device, therein. The packing cushion 100 is made of flexible materials. In the embodiment, the packing cushion 100 is made of pulp based material such as cardboard.

The packing cushion 100 is substantially a hexahedron. The packing cushion 100 includes a rectangular base 15, and four sidewalls (hereinafter, a first sidewall 11, a second sidewall 12, a third sidewall 13, and a fourth sidewall 14) protruding from four rims of the base 15. The first sidewall 11, the second sidewall 12, the third sidewall 13 opposite to the first sidewall 11, and the fourth sidewall 14 opposite to the second sidewall 12 are serially interconnected with each other to define an accommodating space to receive at least a part of the electronic device.

A plurality of protrusions 121, 122, 141, 142 protrude from inner surfaces of the second and fourth sidewalls 12, 14 respectively, to provide cushioning for the electronic device. The protrusions 121, 122, 141, 142 are further connected to the base 15. The protrusions 121, 122 cooperatively define a first contour (not labeled), and the protrusions 141, 142 cooperatively define a second contour (not labeled). The first and second contours match with opposite ends of the electronic device respectively to provide cushioning for the electronic device along a first direction substantially perpendicular to the second and fourth sidewalls 12, 14.

Three first protruding blocks 1512, 1514, and 1516 protrude from an inner surface of the base 15, to provide cushioning for the electronic device along a second direction substantially perpendicular to the first and third sidewalls 11, 13. The first protruding block 1512 is adjacent to the second sidewall 12. The first protruding block 1516 is adjacent to the fourth sidewall 14. The first protruding block 1514 is arranged between the first protruding block 1512, and 1516. The shape of the first protruding blocks 1512, 1514, and 1516 are all similarly D-shaped, but may differ in size from each other. For convenience, the first protruding blocks 1512, 1514, and 1516 hereinafter will generally be referred to simply as "the first protruding blocks 151". Each first protruding block 151 includes a first planar surface 1511. The first planar surfaces 1511 face the third sidewall 13. The three first planar surfaces 1511 cooperatively define a third contour (not labeled) matching with at least another part of the electronic device to provide cushioning for the electronic device.

Two second protruding blocks 113, and two third protruding blocks 114 protrude from an inner surface of the first sidewall 11. The first and second protruding blocks 151, 113 are arranged between the two third protruding blocks 114, and each second protruding block 113 is further arranged between two adjacent first protruding blocks 151.

Each second and third protruding blocks 113, 114 define a second and third planar surface 1132, 1142 respectively. The second and third planar surfaces 1132, 1142 cooperatively define a fourth contour (not labeled). The fourth contour is substantially parallel to the third contour. The fourth contour absorbs impact energy if the third contour deforms, such that the first protruding blocks 151 are protected from deforming too much and losing their ability to rebound.

Two adjacent second and third protruding blocks 113, 114 define a C-shaped first recess 112. Each first recess 112 is corresponding to a first protruding block 151. A part of the first protruding block 151 is received in the corresponding first recess 112, such that each first protruding block 151 and the corresponding first recess 112 form a C-shaped first slot 1122. The first slot 1122 provides a buffer space such that the first protruding blocks 151 are deformable to absorb impacts.

The first and second sidewalls 11, 12, the first protrusion 122, and the third protruding blocks 114 adjacent to the second sidewall 12 cooperatively define a first receiving space 116. The first and fourth sidewalls 11, 14, the second protrusion 142, and the third protruding blocks 114 adjacent to the fourth sidewall 14 cooperatively define a second receiving space 117. The first and second receiving spaces 116, 117 are usable to receive accessories of the electronic device, such as a headset and charger adapter.

Three fourth protruding blocks 1522, 1524, and 1526 protrude form the inner surface of the base 15 to provide further cushioning for the electronic device along the second direction substantially perpendicular to the first and third sidewalls 11, 13. The structure of the fourth protruding blocks 1522, 1524, 1526 are similar to that of the first blocks 151. For convenience, the fourth protruding blocks 1522, 1524, and 1526 hereinafter will generally be referred to simply as "the fourth protruding blocks 152". The fourth protruding blocks 152 are corresponding to the first protruding blocks 151 respectively. Each fourth protruding block 152 includes a second planar surface 1521. The second planar surface 1521 define a fourth contour (not labeled) matching with at least yet another part of the electronic device to provide cushioning for the electronic device.

The structure of the third sidewall 13 is similar to that of the first sidewall 11. Two fifth protruding blocks 134, and two sixth protruding blocks 133 protrude from an inner surface of the third sidewall 13. The fourth and sixth protruding blocks 152, 133 are arranged between the two fifth protruding blocks 134, and each sixth protruding block 133 is further arranged between two adjacent fourth protruding blocks 152.

Each fifth and sixth protruding block 134, 133 defines fourth and fifth planar surfaces 1342, 1332 respectively. The fourth and fifth planar surfaces 1342, 1332 cooperatively define a fifth contour (not labeled). The fifth contour is substantially parallel to the fourth contour.

Two adjacent fifth and sixth protruding block 134, 133 define a C-shaped second recess 132. Each second recess 132 is corresponding to a fourth protruding block 152. A part of the fourth protruding block 152 is received in the corresponding second recess 132, such that each fourth protruding block 152 and the corresponding second recess 132 form a C-shaped slot 1322. The second slot 1322 provides a buffer space such that the first protruding blocks 152 are deformable to absorb impacts.

The second and third sidewalls 12, 13, the first protrusion 121, and the third protruding blocks 1234 adjacent to the second sidewall 12 cooperatively define a third receiving space 118. The third and fourth sidewalls 13, 14, the second protrusion 141, and the third protruding blocks 134 adjacent to the fourth sidewall 14 cooperatively define a fourth receiving space 119. The third and fourth receiving spaces 118, 119 are usable to receive accessories of the electronic device, such as a headset, a power adapter, and a battery. In the embodiment, the structure of the third and fourth receiving spaces 118, 119 is similar to that of the first and second receiving spaces 116, 117.

Three seventh protruding blocks 1532, 1534, and 1536 protrude from the inner surface of the base 15, to provide cushioning for a peripheral portion of the electronic device along a third direction substantially perpendicular to the base 15. The seventh protruding blocks 1532, 1534, and 1536 are sandwiched between the first protruding blocks 151 and the fourth protruding blocks 152. The seventh protruding blocks 1534 are sandwiched between the other seventh protruding blocks 1532, 1536. The seventh protruding block 1522 defines an R-shaped indicator 1544, and another seventh protruding block 1536 defines an arrow indicator 257 for directing an operator to quickly and correctly pack the electronic device in the packing cushion 100.

The first and fourth protruding blocks 151, 152, the first protrusions 121, 122, the second protrusions 141, 144, and the seventh protruding blocks 1542, 1544, and 1546 cooperatively define a receiving space 20 to receive at least a part of the electronic device, such that the electronic device is protected from shocks and vibrations of impacts.

When the electronic device is subjected to an impact and presses the first and fourth protruding blocks 151, 152, the first and fourth protruding blocks 151, 152 deform to absorb energy of impact for a first cushioning. When the electronic device further contacts the second and third planar surfaces 1132, 1142, the second and third protruding blocks 113, 114 as well as the fifth and sixth protruding blocks 153, 154 adapt to also absorb energy of the impact for a second cushioning, such that the first protruding blocks 151 are protected from deforming too much and losing their ability to rebound.

Therefore, when the packing cushion 100 is used, the electronic device to be packed is placed in the receiving space 20 of the packing cushion 100. Because of the cushioning of the packing cushion 100, the object is protected from shocks and vibrations of impacts.

It should be understood that a number of the first, second, fourth, and sixth protruding blocks 151, 113, 152, and 133 are changeable according to a shape of the electronic device to be packed. For similar considerations, a number of the first and second protrusions 121, 122, 141, and 142 are also changeable according to the shape of the electronic device.

Figure 2:
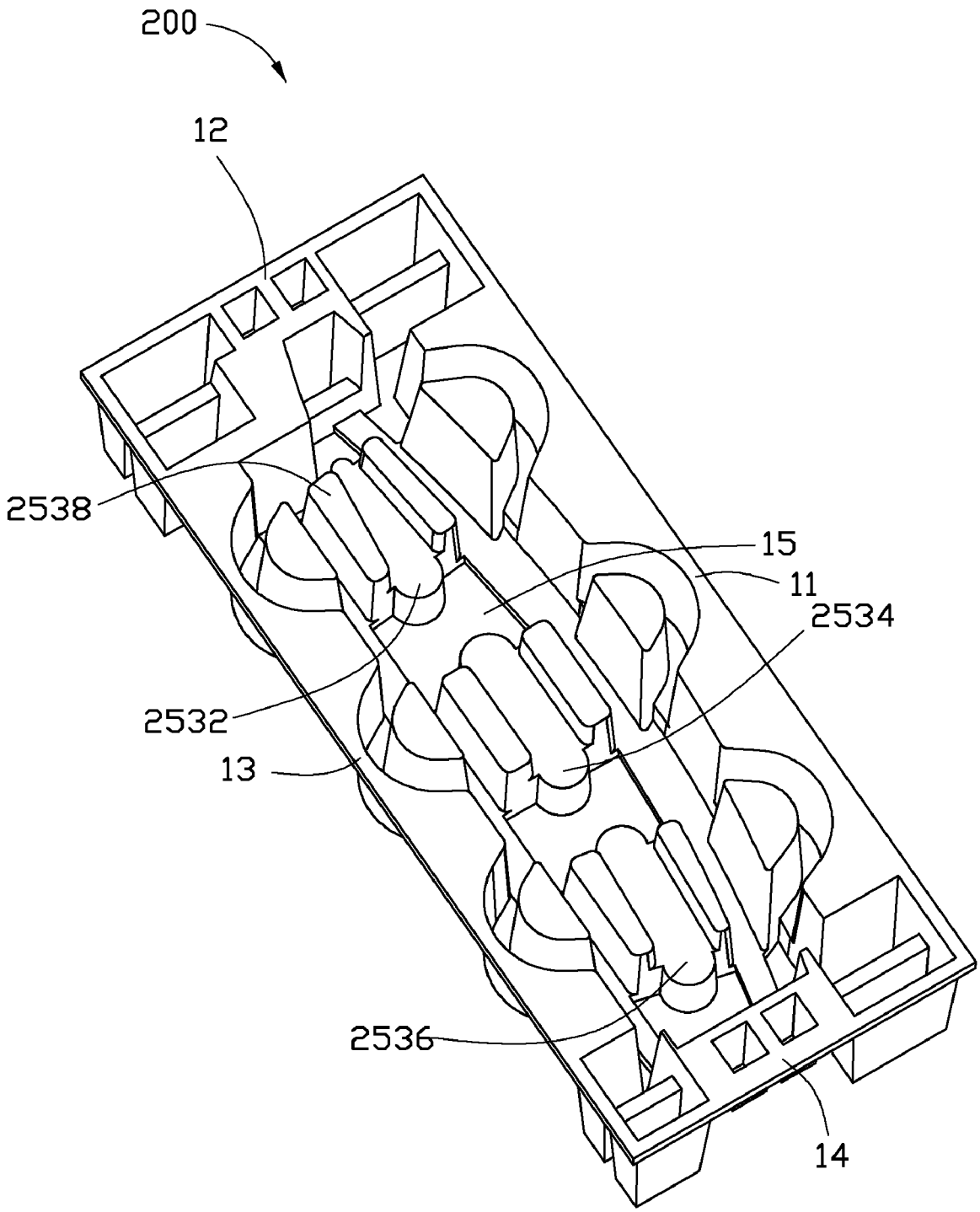
FIG. 2 is a perspective view of a packing cushion in accordance with another embodiment.

Referring to FIG. 2, a packing cushion 200 in accordance with another exemplary embodiment is shown. The packing cushion 200 is similar to the packing cushion 100. The difference between the packing cushion 200 and the packing cushion 100 is that three eighth protruding blocks 2532, 2534, and 2536 protrude from the base 11. The structure of the eighth protruding blocks 2532, 2534, and 2536 are similar, thus, in the following description, for simplicity, the eight protruding block 2532 is selected to be described to explain the difference.

Two ninth protruding blocks 2538 protrude from two ends of the eight protruding block 2532 adjacent to the first and third sidewall 11, 13 respectively. When the electronic device is subjected to an impact, the ninth protruding blocks 2538 are pressed by the electronic device, and the ninth protruding blocks 2538 deform to absorb energy of impact. When the electronic device further presses the ninth protruding blocks 2538, the eighth protruding blocks 2532 adapt to also absorb energy of the impact, such that the ninth protruding blocks 2538 also are protected from deforming too much and losing their ability to rebound.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A packing cushion for packing an object, the packing cushion comprising:

a base; and a plurality of sidewalls coupled to the base, the plurality of sidewalls interconnecting with each other and cooperating with the base to form an accommodating space;

wherein an inner surface of the base defines at least one first protruding block, the at least one first protruding block is arranged adjacent to one of the sidewalls, an inner surface of the sidewall adjacent to the at least one first protruding block defines at least one second protruding block and at least one third protruding block, each first protruding block is arranged between two adjacent a second and third protruding block, a contour defined by the at least one first protruding block matches with at least a part of the object to be packed, when the at least one first protruding block is in an original state, the at least one first protruding block contacts with the object to act as a first cushioning, and the at least one second protruding block and the at least one third protruding block contact with the object to act as a second cushioning when the first protruding blocks deforms enough, wherein a slot within the accommodating space is defined between each first protruding block and the sidewall adjacent thereto to provide a buffer space for when the at least one first protruding block deforms.

2. The packing cushion of claim 1, wherein the at least one first protruding block is substantially D-shaped.

3. The packing cushion of claim 1, wherein a receiving recess is defined between the at least one second and third protruding blocks, the receiving recess corresponds to one of the at least one first protruding block.

4. The packing cushion of claim 3, wherein the receiving recess is substantially C-shaped.

5. The packing cushion of claim 3, wherein a part of the at least one first protruding block is received in the corresponding receiving recess.

6. The packing cushion of claim 5, wherein the slot is formed between the at least one first protruding block and the corresponding receiving recess.

7. A packing cushion, comprising:

a base; and a plurality of sidewalls coupled to the base, the plurality of sidewalls interconnecting with each other and cooperating with the base to form a receiving space;

wherein at least one first cushion portion protrudes from an inner surface of the base and arranged adjacent to one of the sidewalls, at least two second cushion portions protrude from an inner surface of the sidewall adjacent to the at least one first cushion portion, each first cushion portion is arranged between two adjacent second cushion portions, the first cushion portion comprises a first surface, the second cushion portions comprise a second surface, a contour defined by the first surface matches with at least a part of an object to be packed, when the object is packed in the receiving space, the first surface contacts with at least a part of the object to provide a first cushioning, and when the object is subjected to an impact to deform the first cushion portion, the second surface contacts with the object to provide a second cushioning, wherein a slot within the receiving space is defined between each first cushion portion and the sidewall adjacent thereto to provide a buffer space for when the at least one first cushion portion deforms.

8. The packing cushion of claim 7, wherein the second cushion portion integrally protrudes form the sidewall adjacent to the first cushion portion.

9. The packing cushion of claim 8, wherein the sidewall adjacent to the first cushion portion defines a receiving recess, the receiving recess is arranged between two adjacent second cushion portions, and a part of the first cushion portion is received in the receiving recess.

10. The packing cushion of claim 9, wherein the slot is defined between the first cushion portion and the receiving recess corresponding to the first cushion portion.

11. The packing cushion of claim 8, wherein the second surface is sandwiched between the first surface and the sidewall adjacent to the at least one first cushion portion.

12. The packing cushion of claim 7, wherein third and fourth cushion portions protrude from the inner surface of the base.

13. The packing cushion of claim 12, wherein the third and fourth cushion portions are operative to support a top or bottom portion of an object, the fourth cushion portion acts as a third cushioning to absorb impact energy, and when the fourth cushion portion deforms, the third cushion portion acts as a fourth cushion to absorb also impact energy, whereby the fourth cushion portion is protected from deforming too much and losing its ability to rebound.

14. The packing cushion of claim 11, wherein the second surface is parallel to the first surface.

* * * * *